US009995150B2

(12) United States Patent
Lee et al.

(10) Patent No.: US 9,995,150 B2
(45) Date of Patent: Jun. 12, 2018

(54) COOLING CONFIGURATION FOR A GAS TURBINE ENGINE AIRFOIL

(71) Applicant: Siemens Aktiengesellschaft, München (DE)

(72) Inventors: Ching-Pang Lee, Cincinnati, OH (US); Benjamin Heneveld, Newmarket, NH (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 760 days.

(21) Appl. No.: 14/272,553

(22) Filed: May 8, 2014

(65) Prior Publication Data

US 2015/0159489 A1 Jun. 11, 2015

Related U.S. Application Data

(63) Continuation-in-part of application No. 13/657,923, filed on Oct. 23, 2012, now Pat. No. 8,951,004, and a continuation-in-part of application No. 13/658,045, filed on Oct. 23, 2012, now Pat. No. 8,936,067.

(51) Int. Cl.
*F01D 5/18* (2006.01)

(52) U.S. Cl.
CPC ..... *F01D 5/187* (2013.01); *F01D 5/189* (2013.01); *F05D 2250/185* (2013.01); *F05D 2260/2212* (2013.01); *F05D 2260/22141* (2013.01)

(58) Field of Classification Search
CPC . F01D 5/08; F01D 5/187; F01D 5/188; F01D 5/189; F05D 2260/22141; F05D 2250/185
See application file for complete search history.

(56) References Cited

U.S. PATENT DOCUMENTS 3,819,295 A 5/1974 Hauser et al.
4,153,386 A * 5/1979 Leogrande ..... F01D 5/188 415/115
4,203,706 A 5/1980 Hess
4,684,322 A 8/1987 Clifford et al.
(Continued)

FOREIGN PATENT DOCUMENTS

EP 1607577 A2 12/2005
GB 2112467 A 7/1983

*Primary Examiner* — Mark Laurenzi
*Assistant Examiner* — Shafiq Mian

(57) ABSTRACT

A gas turbine engine airfoil includes an outer wall including a suction side, a pressure side, a leading edge, and a trailing edge, the outer wall defining an interior chamber of the airfoil. The airfoil further includes cooling structure provided in the interior chamber. The cooling structure defines an interior cooling cavity and includes a plurality of cooling fluid outlet holes, at least one of which is in communication with a pressure side cooling circuit and at least one of which is in communication with a suction side cooling circuit. At least one of the pressure and suction side cooling circuits includes: a plurality of rows of airfoils, wherein radially adjacent airfoils within a row define segments of cooling channels. Outlets of the segments in one row align aerodynamically with inlets of segments in an adjacent downstream row such that the cooling channels have a serpentine shape.

9 Claims, 8 Drawing Sheets

(56) References Cited

U.S. PATENT DOCUMENTS 5,246,341 A * 9/1993 Hall ..... F01D 5/187 416/97 R
5,370,499 A 12/1994 Lee
5,601,399 A * 2/1997 Okpara ..... F01D 5/187 415/115
5,690,472 A 11/1997 Lee
5,704,763 A 1/1998 Lee
5,752,801 A 5/1998 Kennedy
6,004,095 A 12/1999 Waitz et al.
6,099,252 A * 8/2000 Manning ..... F01D 5/187 415/116
6,254,334 B1 7/2001 LeFleur
6,402,470 B1 * 6/2002 Kvasnak ..... F01D 5/187 415/115
7,182,576 B2 2/2007 Bunker et al.
7,232,290 B2 6/2007 Draper et al.
7,311,498 B2 12/2007 Cunha et al.
7,435,053 B2 10/2008 Liang
7,478,994 B2 1/2009 Cunha et al.
7,549,844 B2 6/2009 Liang
7,572,103 B2 * 8/2009 Walters ..... F01D 5/187 416/96 R
7,670,113 B1 3/2010 Liang
7,713,026 B1 5/2010 Liang
7,753,650 B1 7/2010 Liang
7,785,071 B1 8/2010 Liang
8,052,378 B2 11/2011 Draper
8,092,175 B2 1/2012 Beeck et al.
8,109,726 B2 * 2/2012 Liang ..... F01D 5/187 416/97 R
8,157,504 B2 4/2012 Amaral et al.
8,348,613 B2 1/2013 Gregg et al.
8,807,943 B1 * 8/2014 Liang ..... F01D 5/187 415/115
2006/0133935 A1 6/2006 Papple
2007/0128028 A1 * 6/2007 Liang ..... F01D 5/187 416/97 R
2007/0189897 A1 * 8/2007 Pietraszkiewicz ..... F01D 5/186 416/97 R
2008/0101961 A1 5/2008 Liang et al.
2009/0047136 A1 * 2/2009 Chon ..... F01D 5/187 416/97 R
2009/0285684 A1 * 11/2009 Pinero ..... F01D 5/187 416/92
2010/0008761 A1 1/2010 Piggush et al.
2010/0247284 A1 * 9/2010 Gregg ..... F01D 5/189 415/1
2013/0108416 A1 * 5/2013 Piggush ..... F01D 5/187 415/173.1
2013/0243575 A1 * 9/2013 Zelesky ..... F01D 5/187 415/116

* cited by examiner

COOLING CONFIGURATION FOR A GAS TURBINE ENGINE AIRFOIL

CROSS REFERENCE TO RELATED APPLICATIONS

This application is a continuation in part of U.S. patent application Ser. No. 13/657,923, filed Oct. 23, 2012 entitled "COOLING ARRANGEMENT FOR A GAS TURBINE COMPONENT," the entire disclosure of which is hereby incorporated by reference herein. This application is also a continuation in part of U.S. patent application Ser. No. 13/658,045, filed Oct. 23, 2012 entitled "CASTING CORE FOR A COOLING ARRANGEMENT FOR A GAS TURBINE COMPONENT," the entire disclosure of which is hereby incorporated by reference herein.

FIELD OF THE INVENTION

The invention relates to a cooling configuration in a gas turbine engine airfoil. In particular, the invention relates to a cooling structure in an interior chamber of the airfoil, wherein pressure and suction side cooling circuits are defined between the cooling structure and the respective pressure and suction sides of the airfoil.

BACKGROUND OF THE INVENTION

Gas turbine engines create combustion gas which is expanded through a turbine to generate power. The combustion gas is often heated to a temperature which exceeds the capability of the substrates used to form many of the components in the turbine. To address this, the substrates are often coated with thermal barrier coatings (TBC) and also often include cooling passages throughout the component. A cooling fluid such as compressed air created by the gas turbine engine's compressor is typically directed into an internal passage of the substrate. From there, it flows into the cooling passages and exits through an opening in the surface of the component and into the flow of combustion gas.

Certain turbine components are particularly challenging to cool, such as those components having thin sections. The thin sections have relatively large surface area that is exposed to the combustion gas, but a small volume with which to form cooling channels to remove the heat imparted by the combustion gas. Examples of components with a thin section are those having an airfoil, such as turbine blades and stationary vanes. The airfoil usually has a thin trailing edge.

Various cooling schemes have been attempted to strike a balance between the competing factors. For example, some blades use structures in the trailing edge, where cooling air flowing between the structures in a first row is accelerated and impinges on structures in a second row. A faster flow of cooling fluid will more efficiently cool than will a slower flow of the same cooling fluid. This may be repeated to achieve double impingement cooling, and repeated again to achieve triple impingement cooling, after which the cooling air may exit the substrate through an opening in the trailing edge, where the cooling air enters the flow of combustion gas passing thereby. The impingement not only cools the interior surface of the component, but it also helps regulate the flow. In particular, it may create an increased resistance to flow along the cooling channel and this may prevent use of excess cooling air.

For cost efficient cooling design, the trailing edge is typically cast integrally with the entire blade using a ceramic core. The features and size of the ceramic core are important factors in the trailing edge design. A larger size of a core feature makes casting easier, but the larger features are not optimal for metering the flow through the crossover holes to achieve efficient cooling. In the trailing edge, for example, since cavities in the substrate correspond to core material, a crossover holes between the adjacent pin fins in a row corresponds to sparse casting core material in that location of the casting. This, in turn, leads to fragile castings that may not survive normal handling. To achieve acceptable core strength the crossover holes must exceed a size optimal for cooling efficiency purposes. However, the crossover holes result in more cooling flow which is not desirable for turbine efficiency. Consequently, there remains room in the art for improvement.

SUMMARY OF THE INVENTION

In accordance with a first aspect of the present invention, a gas turbine engine airfoil is provided. The airfoil comprises an outer wall including a radially inner end, a radially outer end, a suction side, a pressure side, a leading edge, and a trailing edge, the outer wall defining an interior chamber of the airfoil. The airfoil further comprises cooling structure provided in the interior chamber. The cooling structure defines an interior cooling cavity and includes a plurality of cooling fluid outlet holes, at least one of the outlet holes in communication with a pressure side cooling circuit and at least one of the outlet holes in communication with a suction side cooling circuit. At least one of the pressure side cooling circuit and the suction side cooling circuit comprises: a plurality of rows of airfoils, wherein radially adjacent airfoils within a row define segments of cooling channels. Outlets of the segments in one row align aerodynamically with inlets of segments in an adjacent downstream row such that the cooling channels have a serpentine shape.

The cooling structure may comprise an insert separately formed from the outer wall of the airfoil and fitted into the interior chamber of the outer wall.

The cooling structure may be located closer to the leading edge of the outer wall than to the trailing edge of the outer wall.

At least some of the outlet holes in the cooling structure may discharge cooling fluid from the interior cooling cavity of the cooling structure at least partially in a direction toward the leading edge of the outer wall.

The outlet holes in the cooling structure may only discharge cooling fluid from the interior cooling cavity of the cooling structure in a direction directly toward the leading edge of the outer wall.

The airfoil may further comprise a trailing edge cooling cavity comprising: a plurality of rows of airfoils, wherein radially adjacent airfoils within a row define segments of cooling channels, and wherein outlets of the segments in one row align aerodynamically with inlets of segments in an adjacent downstream row such that the cooling channels in the trailing edge cooling cavity have a serpentine shape.

Each of the pressure side cooling circuit and the suction side cooling circuit may comprise: a plurality of rows of airfoils, wherein radially adjacent airfoils within a row define segments of cooling channels, and wherein outlets of the segments in one row align aerodynamically with inlets of segments in an adjacent downstream row such that the cooling channels in each of the pressure side cooling circuit and the suction side cooling circuit have a serpentine shape.

The cooling channels may comprise turbulating features.

The cooling channels may be defined between an outer side of the cooling structure and an inner side of one of the pressure side and the suction side of the outer wall.

The cooling channels may include at least one outlet passage extending to one of the pressure side and the suction side of the outer wall. The cooling channels may include a plurality of radially spaced apart outlet passages extending to one of the pressure side and the suction side of the outer wall. The outlet passages of the cooling channels may discharge cooling fluid from the airfoil in a direction toward the trailing edge of the outer wall.

In accordance with a second aspect of the present invention, a gas turbine engine airfoil is provided. The airfoil comprises an outer wall including a radially inner end, a radially outer end, a suction side, a pressure side, a leading edge, and a trailing edge, the outer wall defining an interior chamber of the airfoil. The airfoil may further comprise cooling structure provided in the interior chamber, the cooling structure: located closer to the leading edge of the outer wall than to the trailing edge of the outer wall; defining an interior cooling cavity; and including a plurality of cooling fluid outlet holes. At least one of the outlet holes is in communication with a pressure side cooling circuit and discharges cooling fluid from the interior cooling cavity of the cooling structure at least partially in a direction toward the leading edge of the outer wall, and at least one of the outlet holes is in communication with a suction side cooling circuit and discharges cooling fluid from the interior cooling cavity of the cooling structure at least partially in a direction toward the leading edge of the outer wall. Each of the pressure side cooling circuit and the suction side cooling circuit comprise: a plurality of rows of airfoils, wherein radially adjacent airfoils within a row define segments of cooling channels, and wherein outlets of the segments in one row align aerodynamically with inlets of segments in an adjacent downstream row to define continuous cooling channels with non continuous walls, each cooling channel comprising a serpentine shape.

BRIEF DESCRIPTION OF THE DRAWINGS

The invention is explained in the following description in view of the drawings that show.

DETAILED DESCRIPTION OF THE INVENTION

The present inventors have devised an innovative cooling arrangement for use in a cooled component. The component may be manufactured by casting a substrate around a core to produce a turbine blade or vane having a monolithic substrate, or it may be made of sheet material, such as a transition duct. The cooling arrangement may include cooling channels characterized by a serpentine or zigzag flow axis, where the cooling channel walls are defined by rows of discrete aerodynamic structures that form continuous cooling channels having discontinuous walls. The aerodynamic structures may be airfoils or the like. The cooling channels may further include other cooling features such as turbulators, and may further be defined by other structures such as pin fins or mesh cooling passages. The cooled component may include items such as blades, vanes, and transition ducts etc. that have thin regions with relatively larger surface area. An example of such a thin area is a trailing edge of the blade or vane, but is not limited to these thin areas or to these components.

The cooling arrangement disclosed herein enables highly efficient cooling by providing increased surface area for cooling and sufficient resistance to the flow of cooling air while also enabling a core design of greater strength. Traditional flow restricting impingement structures regulated an amount of cooling fluid used by restricting the flow, and this restriction also accelerated the flow in places. A faster moving flow provides a higher heat transfer coefficient, which, in turn, improves cooling efficiency. In the cooling arrangement disclosed herein, the serpentine cooling channels provide sufficient resistance to the flow to obviate the need for the flow restricting effect of the traditional impingement structures. The increased surface area and associated increase in cooling channel length yields an increase in cooling, despite the relatively slower moving cooling fluid having a relatively lower heat transfer coefficient when compared to the faster moving fluid of the impingement-based cooling schemes. The result is that the cooling arrangement disclosed herein yields an increase in overall heat transfer because the positive effect of the increase in surface area more than overcomes the negative effect of the decreased heat transfer coefficient. The satisfactory flow resistance offered by the serpentine shape of the cooling channel is sufficient to regulate the flow and thereby enable the cooling arrangement, with or without the assistance of an array of pin fins or the like. Experimental data indicated upwards of a 40 degree Kelvin temperature drop at a point on the surface of the blade when the cooling arrangement disclosed herein is implemented.

Figure 1:
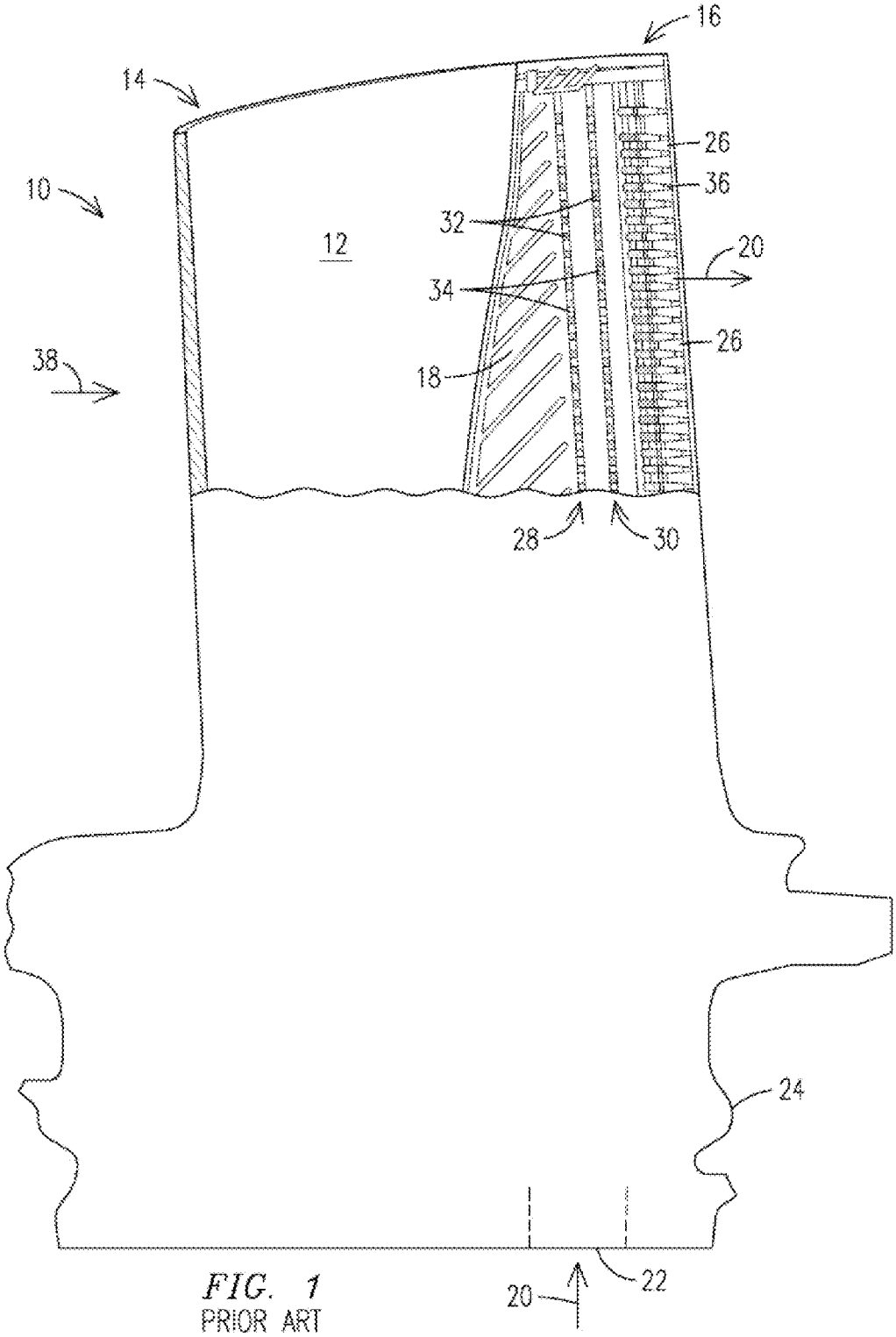
FIG. 1 PRIOR ART
FIG. 1 is a cross sectional side view of a prior art turbine blade.

FIG. 1 shows a cross section of a prior art turbine blade 10 with an airfoil 12, a leading edge 14 and a trailing edge 16. The prior art turbine blade 10 includes a trailing edge radial cavity 18. Cooling fluid 20 enters the trailing edge radial cavity 18 through an opening 22 in a base 24 of the prior art turbine blade 10. The cooling fluid 20 travels radially outward and then travels toward exits 26 in the trailing edge 16. As the cooling fluid 20 travels toward the trailing edge exit 26 it encounters a first row 28 and a second row 30 of crossover hole structures 32. The cooling fluid 20 flows through relatively narrow crossover holes 34 between the crossover hole structures 32 of the first row 28, which accelerates the cooling fluid which, in turn, increases the heat transfer coefficient in a region where the accelerated fluid flows. The cooling fluid 20 impinges on the crossover hole structures 32 of the second row 30, and is again accelerated through crossover holes 34 between the crossover hole structures 32 of the second row 30. Here again the accelerated fluid results in a higher heat transfer coefficient in the region of accelerated fluid flow. The cooling fluid 20 then impinges on a final structure 36 which keep the fluid flowing at a fast rate before exiting the prior art turbine blade 10 through the trailing edge exits 26 where the cooling fluid 20 joins a flow of combustion gas 38 flowing thereby. Between the trailing edge radial cavity 18 and the trailing edge exit 26 individual flows between the crossover hole structures 32 may be subsequently split when impinging another crossover hole structures 32 or final structure 36, and split flows may be joined with other adjacent split flows. Consequently, it is difficult to describe the cooling arrangement in the prior art trailing edge 16 as continuous cooling channels; it is better characterized as a field of structures that define discontinuous pathways where individual flows of cooling fluid 20 split and merge at various locations throughout.

Figure 2:
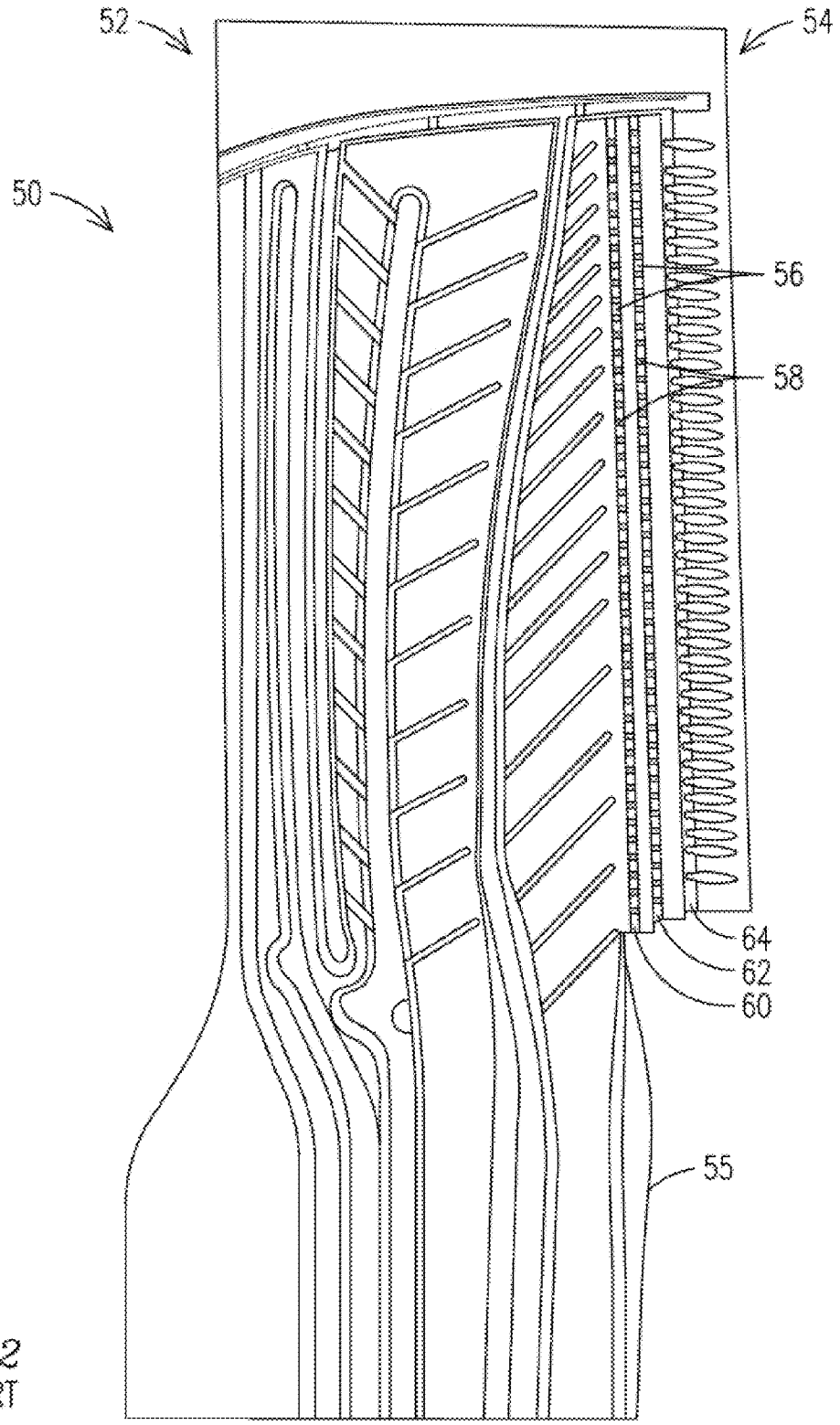
FIG. 2 PRIOR ART
FIG. 2 shows a core used to manufacture the prior art turbine blade shown in FIG. 1.

FIG. 2 shows a prior art core 50 with a core leading edge 52 and a core trailing edge 54 and a core base 55. During manufacture a substrate material (not shown) may be cast around the prior art core 50. The solidified cast material becomes the substrate of the component. The prior art core 50 is removed by any of several methods known to those of ordinary skill in the art. What remains once the prior art core 50 is removed is a hollow interior that forms the trailing edge radial cavity 18 and the crossover holes 34, among others. For example, core crossover hole structure gaps 56 are openings in the prior art core 50 which will be filled with substrate material and form crossover hole structures 32 in the prior art blade 10 (or vane etc.). Conversely, core crossover hole structures 58 between the core crossover hole structure gaps 56 will block material in the substrate so that once the prior art core 50 is removed the crossover holes 34 will be formed. It can be seen that the core crossover hole structures 58 are relatively small in terms of depth (into the page) and height (y axis on the page) and provide a weak regions 60, 62, 64 that correspond to locations in the prior art core 50 that form the first row 28, the second row 30, and the row of final structures 36 in the finished prior art turbine blade 10. These weak regions 60, 62, and 64 may break prior to casting of the substrate material and this is costly in terms of material and lost labor etc.

Figure 3:
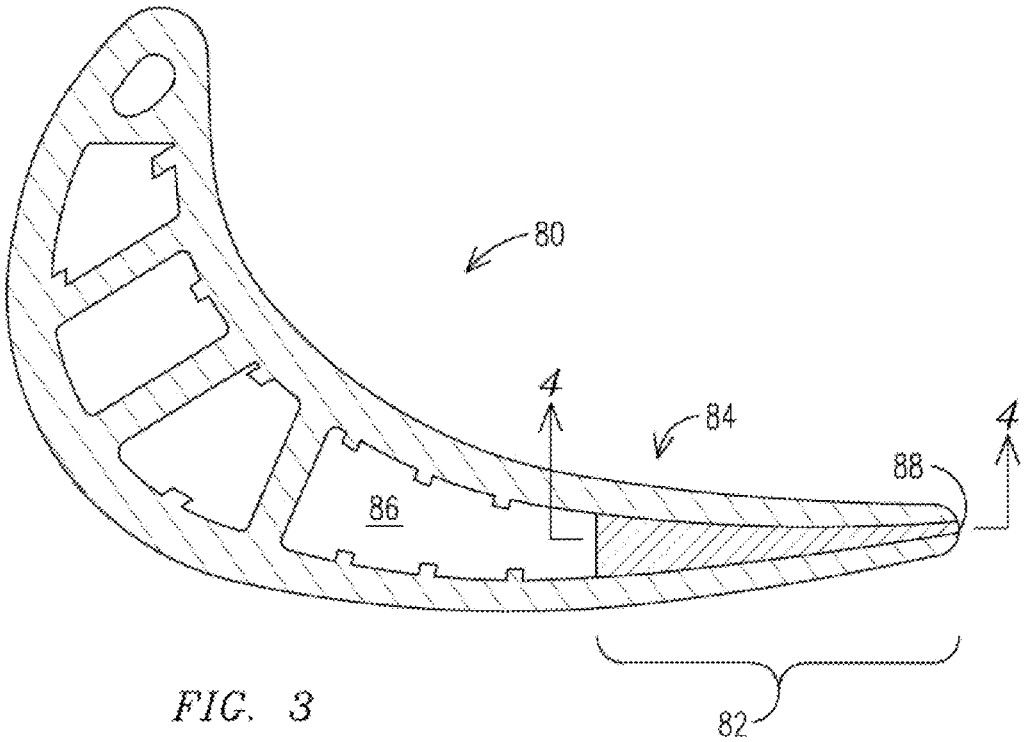
FIG. 3 is a cross sectional end view of a turbine blade.

FIG. 3 is a cross sectional end view of a turbine blade 80 having the cooling arrangement 82 disclosed herein in a trailing edge 84 of the turbine blade 80. The cooling arrangement 82 is not limited to a trailing edge 84 of a turbine blade 80, but can be disposed in any location where there exists a relatively large surface area to be cooled. In the exemplary embodiment shown the cooling arrangement 82 spans from the trailing edge radial cavity 86 to the trailing edge exits 88.

Figure 4:
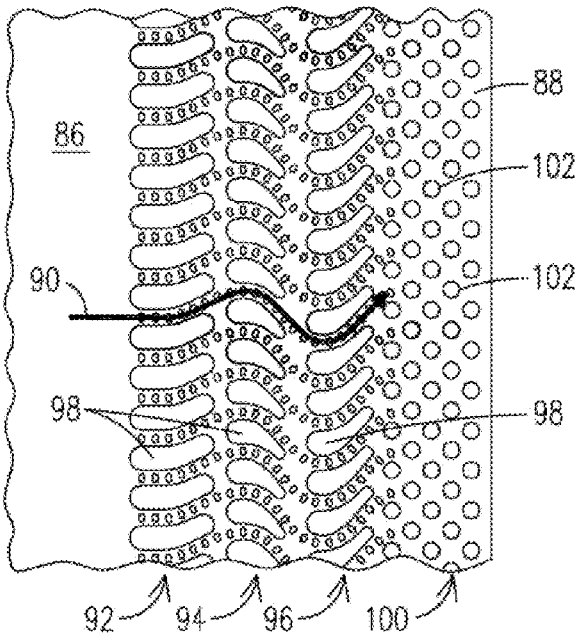
FIG. 4 is a partial cross sectional side view along 4-4 of the turbine blade of FIG. 3 showing the cooling channels disclosed herein.

FIG. 4 is a partial cross sectional side view along 4-4 of the turbine blade 80 of FIG. 3 showing cooling channels 90 of the cooling arrangement 82. In the exemplary embodiment shown the cooling channels 90 are defined by a first row 92, a second row 94, and a third row 96 of flow defining structures 98 and are continuous and discrete paths for a cooling fluid. However, each cooling channel 90 is not continuously bounded by flow defining structures 98. Instead, between rows 92, 94, 96 of flow defining structures 98 each cooling channel 90 is free to communicate with an adjacent cooling channel 90. Downstream of the cooling channels 90 there may be an array 100 of pin fins 102 or other similar structures used to enhance cooling, meter the flow of cooling fluid, and provide strength to both the turbine blade 80 and the prior art core 50. In the exemplary embodiment shown the flow defining segments 98 take the form of an airfoil, but other shapes may be used.

Figure 5:
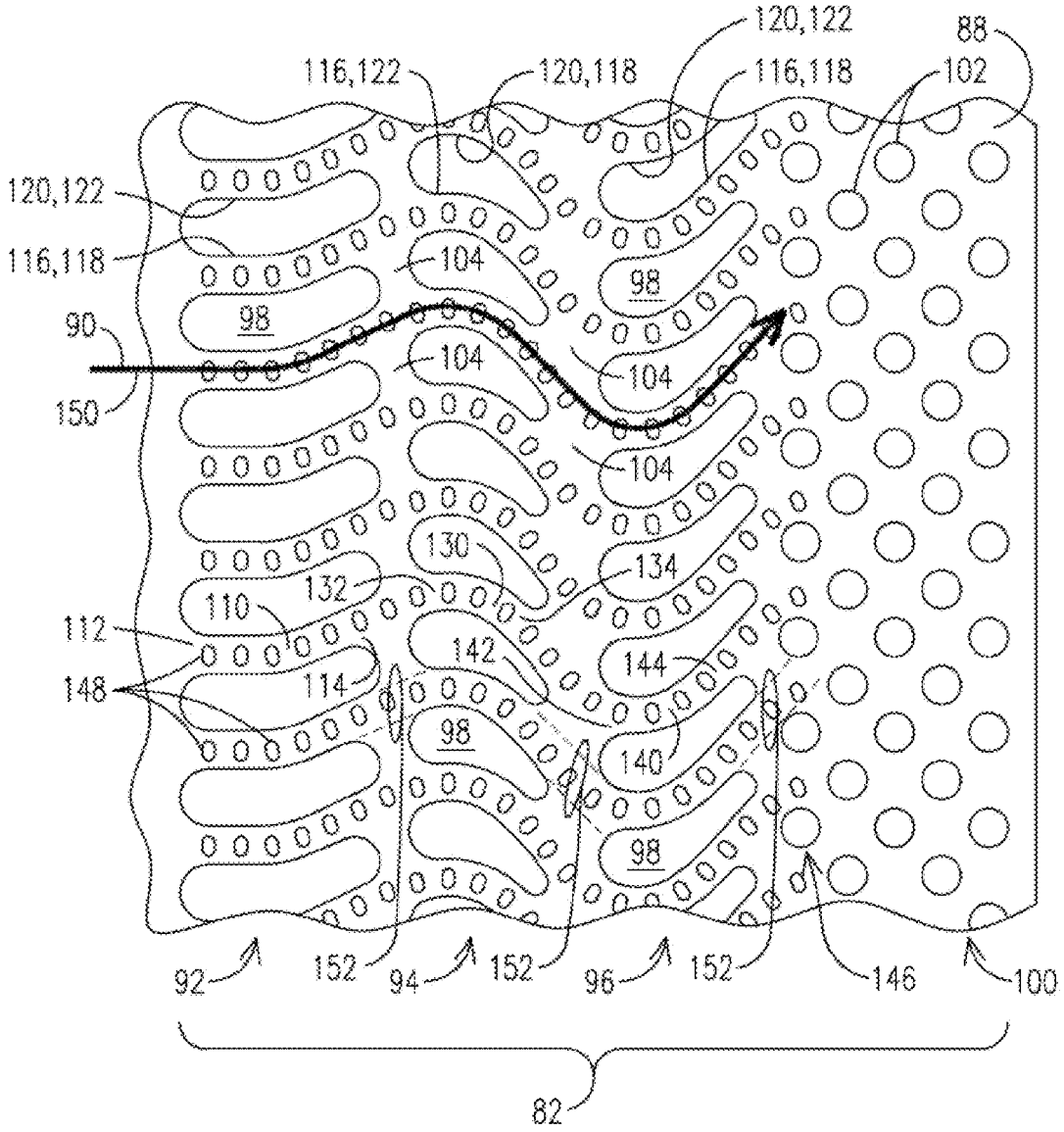
FIG. 5 is a close up view of the cooling arrangement of FIG. 4.

FIG. 5 is a close up view of the cooling arrangement 82 of FIG. 4. Each cooling channel 90 includes at least two segments where the cooling channel is bounded by flow defining structures 98 that provide bounding walls. In between segments the cooling channel 90 may be unbounded by walls where cross paths 104 permit fluid communication between adjacent cooling channels 90 and contribute to an increase in surface area available for cooling inside the turbine blade 80. The cooling channels may open into the array 100 of pin fins 102. In the exemplary embodiment shown there are three rows 92, 94, 96, of flow defining structures 98, and hence three segments per cooling channel 90.

The first row 92 of flow defining structures 98 defines a first segment 110 having a first segment inlet 112 and a first segment outlet 114. In the first row 92 a first wall 116 of the cooling channel 90 is defined by a suction side 118 of the flow defining structure 98. A second wall 120 of the cooling channel 90 is defined by a pressure side 122 of the flow defining structure 98. Between the first row 92 and the second row 94 the cooling channel is not bounded by walls, but is instead open to adjacent channels via the cross paths 104.

The second row 94 of flow defining structures 98 defines a second segment 130 having a second segment inlet 132 and a second segment outlet 134. In the second row 94 the first wall 116 of the cooling channel 90 is now defined by a pressure side 122 of the flow defining structure 98. The second wall 120 of the cooling channel 90 is now defined by the suction side 118 of the flow defining structure 98. Between the second row 94 and the third row 96 the cooling channel is not bounded by walls, but is instead open to adjacent channels via the cross paths 104.

The third row 96 of flow defining structures 98 defines a third segment 140 having a third segment inlet 142 and a third segment outlet 144. In the third row 96 the first wall 116 of the cooling channel 90 is defined by a suction side 118 of the flow defining structure 98. The second wall 120 of the cooling channel 90 is defined by a pressure side 122 of the flow defining structure 98. The cooling channel 90 ends at the third segment outlet 144, where the cooling channel may open to the array 100 of pin fins 102. The array 100 of pin fins 102 may or may not be included in the cooling arrangement 82.

Unlike conventional impingement based cooling arrangements, the instant cooling arrangement 82 aligns the outlets and inlets of the segments so that cooling air exiting an outlet is aimed toward the next segment's inlet. This aiming may be done along a line of sight (mechanical alignment), or it may be configured to take into account the aerodynamic effects present during operation. In a line of sight/mechanical alignment an axial extension 152 of an outlet in a flow direction will align with an inlet of the next/downstream inlet. An aerodynamic alignment may be accomplished, for instance, via fluid modeling etc. In such instances an axial extension of an outlet may not align exactly mechanically with an inlet of the next/downstream inlet, but in operation the fluid exiting the outlet will be directed toward the next inlet in a manner that accounts for aerodynamic influences, such as those generated by adjacent flows, or rotation of the blade etc. It is understood that the cooling fluid may not exactly adhere to the path an axial extension may take, or a path on which it is aimed in an aerodynamic alignment, but it is intended that the fluid will flow substantially from an outlet to the next inlet. Essentially, the fluid may be guided to avoid or minimize impingement, contrary to the prior art.

This aiming technique may also be applied to cooling fluid exiting the third segment outlet 144 at the end of the cooling channel 90. In particular an axial extension of the third segment outlet 144 may be aimed between pin fins 102 in a first row 146 of pin fins 102 in the array 100. Likewise the flow exiting the third segment outlet 144 may be aerodynamically aimed between the pin fins 102 in the first row 146. Still further, downstream rows of pin fins may or may not align to permit an axial extension of the third segment outlet 144 to extend uninterrupted all the way through the trailing edge exits 88. The described configuration results in a cooling channel 90 with a serpentine flow axis 150. The serpentine shape may include a zigzag shape.

The cooling channels 90 may have turbulators to enhance heat transfer. In the exemplary embodiment shown the cooling channels 90 include mini ribs, bumps or dimples 148. Alternatives include other shapes known to those of ordinary skill in the art. These turbulators increase surface area and introduce turbulence into the flow, which improves heat transfer.

Figure 6:
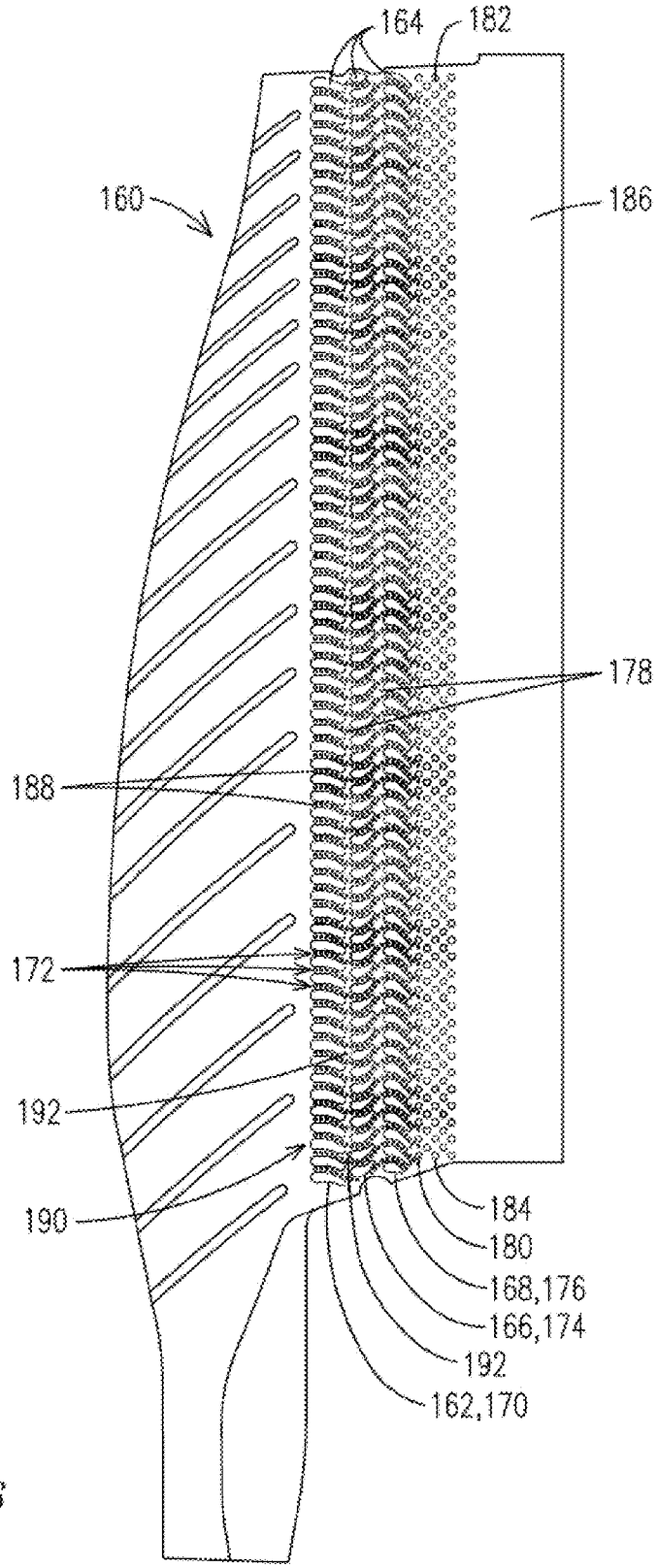
FIG. 6 shows a portion of a core used to manufacture the turbine blade of FIG. 4.

FIG. 6 shows an improved portion 160 of an improved core, the improved portion 160 being for the trailing edge radial cavity 86 and designed to create the cooling arrangement 82 disclosed herein. (The remainder of the improved core would remain the same as shown in FIG. 2.) A first row 162 of core flow defining structure gaps 164, a second row 166 of core flow defining gaps 164, and a third row 168 of core flow defining gaps 164 are present in the improved core portion 160 where the first row 92, the second row 94, and the third row 96 of flow defining structures 98 respectively will be formed in the cast component. A first row 170 of interstitial core material 172 separates the core flow defining structure gaps 164 in the first row 162 from each other.

A second row 174 of interstitial core material 172 separates the core flow defining structure gaps 164 in the second row 166 from each other. A third row 176 of interstitial core material 172 separates the core flow defining structure gaps 164 in the third row 166 from each other. Each row (170, 174, 176) of interstitial core material is connected to an adjacent row with connecting core material 178 that spans the rows (170, 174, 176) of interstitial core material. A first row 180 of core pin fin gaps 182 begins an array 184 of pin fin gaps 182 where the first row 146 of pin fins 102 and the array 100 of pin fins 102 will be formed in the cast component. Also visible are core turbulator features 188 where mini ribs, bumps or dimples 148 will be present on the cast component. The improved portion 160 may also include surplus core material 186 as necessary to aid the casting process.

When compared to the trailing edge portion of the prior art core 50 of FIG. 2, it can be seen that the improved core portion 160 is structurally more sound than the trailing edge portion of the prior art core 50. In particular, the improved core portion 160 does not have the weak regions 60, 62, 64 which include material that is relatively small in terms of depth (into the page) and height (y axis on the page). Instead, the rows 170, 174, 176 of interstitial core material 172 are present between the core flow defining structure gaps 162 in the improved core portion, and the interstitial core material 172 has a same depth as the flow defining structure gaps 162 themselves (i.e. the interstitial core material 172 is as thick as the bulk of the improved core portion 160) and thus the improved core portion 160 is stronger than the prior art design.

Stated another way, a first region 190 immediately upstream of a respective row of the interstitial core material 172 has a first region thickness. A second region 192 immediately downstream of a respective row of the interstitial core material 172 has a second region thickness. The interstitial core material 172 between the first region and the second region has an upstream interstitial core material thickness that matches the first region thickness because they blend together at an upstream end of the interstitial core material 172. The interstitial core material 172 has a downstream interstitial core material thickness that matches the second region thickness because they blend together at a downstream end of the interstitial core material 172. The interstitial core material 172 maintains a maximum thickness between the upstream end and the downstream end. This configuration is the same for all of the rows 170, 174, 176 of interstitial core material 172. Since there is no reduction in thickness of the improved core portion 160 where the interstitial core material 172 is present, the improved core portion 160 is much stronger than the prior art core portion 50. This reduces the chance of core fracture and provides lower manufacturing costs associated there with. Furthermore, the relatively larger cooling passages disclosed herein are less susceptible to clogging from debris that may find its way into the cooling passage than the crossover holes of the prior art configuration.

The cooling arrangement disclosed herein replaces the impingement cooling arrangements of the prior art which accelerate the flow to increase the cooling efficiency with a cooling arrangement having serpentine cooling channels. The serpentine channels provide sufficient resistance to flow to enable efficient use of compressed air as a cooling fluid, and the increased surface area improves an overall heat transfer quotient of the cooling arrangement. Further, the improved structure can be cast using a core with improved core strength. As a result, cooling efficiency is improved and manufacturing costs are reduced. Consequently, this cooling arrangement represents an improvement in the art.

Figure 7:
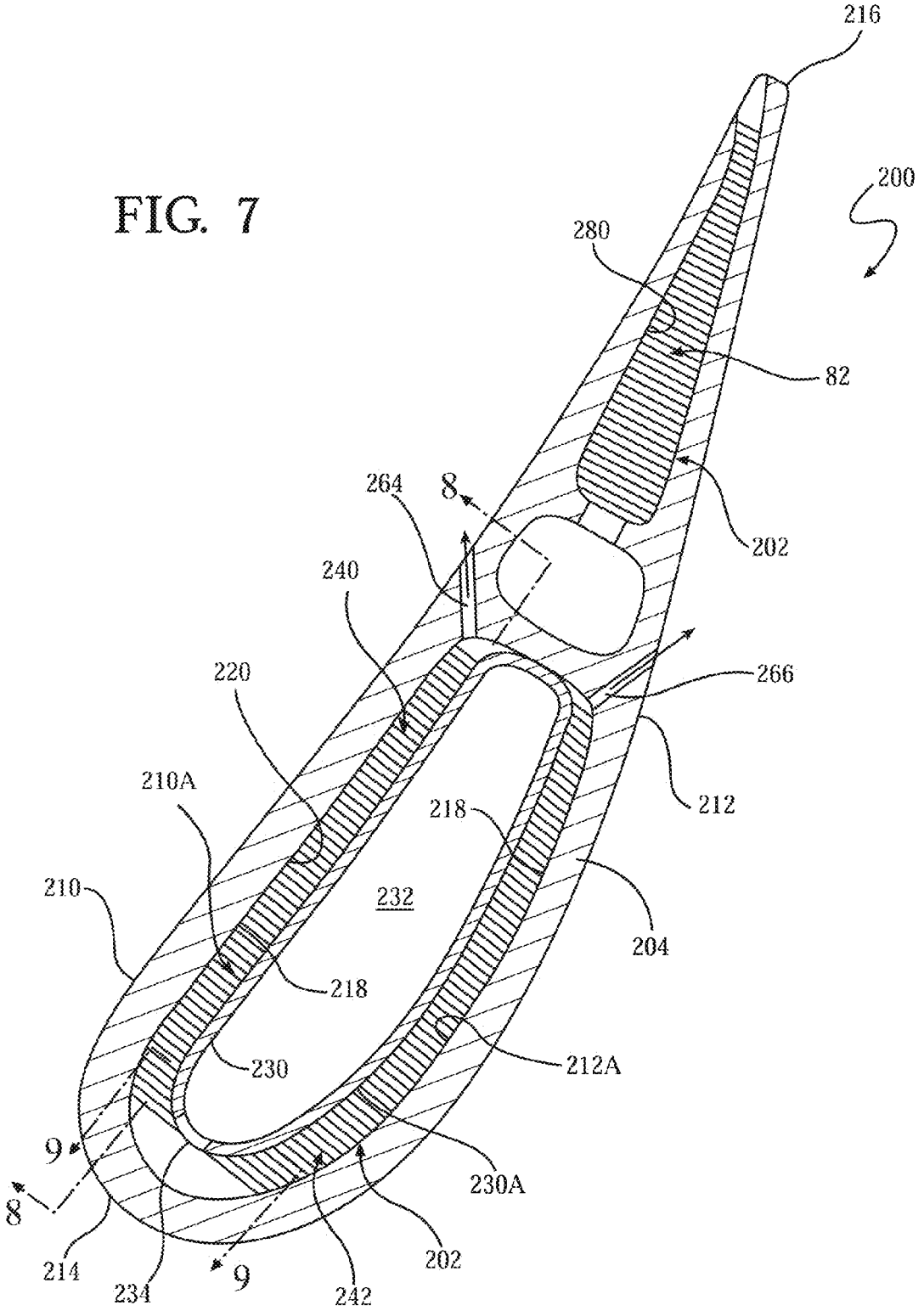
FIG. 7 shows a cross sectional end view of a turbine blade in accordance with another aspect of the present invention.

Referring now to FIG. 7, a gas turbine engine airfoil 200 constructed in accordance with another aspect of the invention and including a cooling configuration 202 is shown. The airfoil 200 illustrated in FIG. 7 is a stationary vane, but the cooling configuration 202 could also be applied in a rotatable blade without departing from the scope and spirit of the invention.

The airfoil 200 includes an outer wall 204 defining a main structural component of the airfoil 200. The outer wall 204 includes a radially inner end 206, a radially outer end 208 (see FIG. 8), a pressure side 210, a suction side 212, a leading edge 214, and a trailing edge 216. The outer wall 204 includes an inner side 218 that defines an interior chamber 220 of the airfoil 200.

The airfoil 200 further comprises cooling structure 230 provided in the interior chamber 220, the cooling structure 230 used for cooling of portions of the airfoil 200. The cooling structure 230 defines an interior cooling cavity 232 within the airfoil 200, i.e., within the cooling structure 230. The cooling structure 230 may comprise a rigid insert that is preferably separately formed from the outer wall 204 of the airfoil 200, wherein the insert is tightly fitted into the interior chamber 220 of the outer wall 204, e.g., to reduce or avoid relative movement between the insert and the outer wall 204 during operation. Alternatively, it is noted that the cooling structure 230 could be integrally formed with the outer wall 204 without departing from the scope and spirit of the invention. As shown in FIG. 7, the cooling structure 230 is located closer to the leading edge 214 of the outer wall 204 than to the trailing edge 216 of the outer wall 216.

Figure 9:
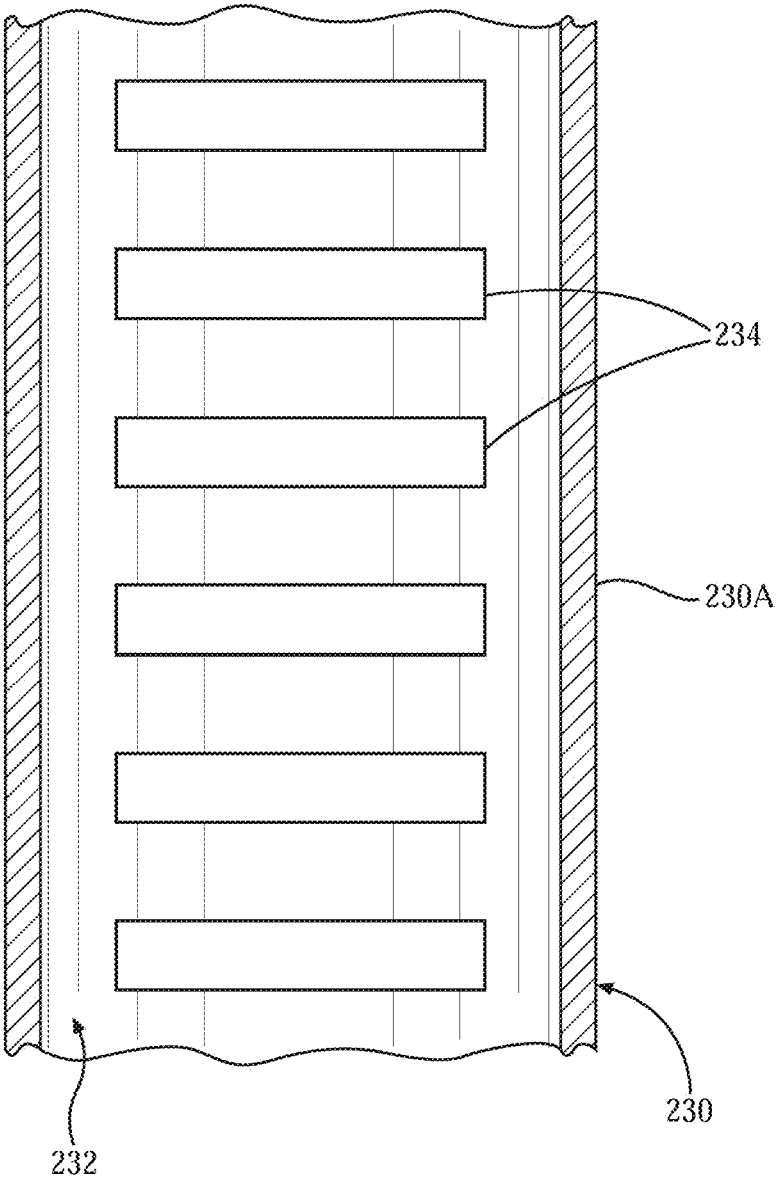
FIG. 9 is an enlarged partial cross sectional view along 9-9 from FIG. 7 and showing a portion of turbine blade insert, wherein the remainder of the blade has been removed from FIG. 9 for clarity.

Referring now to FIGS. 7 and 9, the cooling structure 230 includes a plurality of cooling fluid outlet holes 234. In the embodiment shown, the outlet holes 234 have a generally rectangular shape and are radially spaced apart from one another, although it is understood that the outlet holes 234 could have any shape or configuration, such as, for example, small (or large) circular holes, square holes, ovular holes, etc. At least one of the outlet holes 234 is in communication with a pressure side cooling circuit 240, and at least one of the outlet holes 234 is in communication with a suction side cooling circuit 242, see FIG. 7. In the embodiment shown, each of the outlet holes 234 is in communication with both of the pressure and suction side cooling circuits 240, 242, although this need not be the case, i.e., select one(s) of the outlet holes 234 may be in communication with only one of the pressure and suction side cooling circuits 240, 242.

As shown in FIG. 7, the outlet holes 234 in the cooling structure 230 preferably discharge cooling fluid from the interior cooling cavity 232 of the cooling structure 230 at least partially in a direction toward the leading edge 214 of the outer wall 204. In the embodiment shown, the outlet holes 234 only discharge cooling fluid in a direction directly toward the leading edge 214 of the outer wall 204. Hence, substantially all of the cooling fluid discharged from the interior cooling cavity 232 cools the leading edge 214 of the outer wall 204, e.g., by impingement and/or convection cooling, wherein the cooling fluid is then split between the pressure and suction side cooling circuits 240, 242. It is noted that depending on heat load, film cooling holes (not shown), e.g., arranged in a known showerhead configuration, may be present in the leading edge 214 of the outer wall 204.

Figure 8:
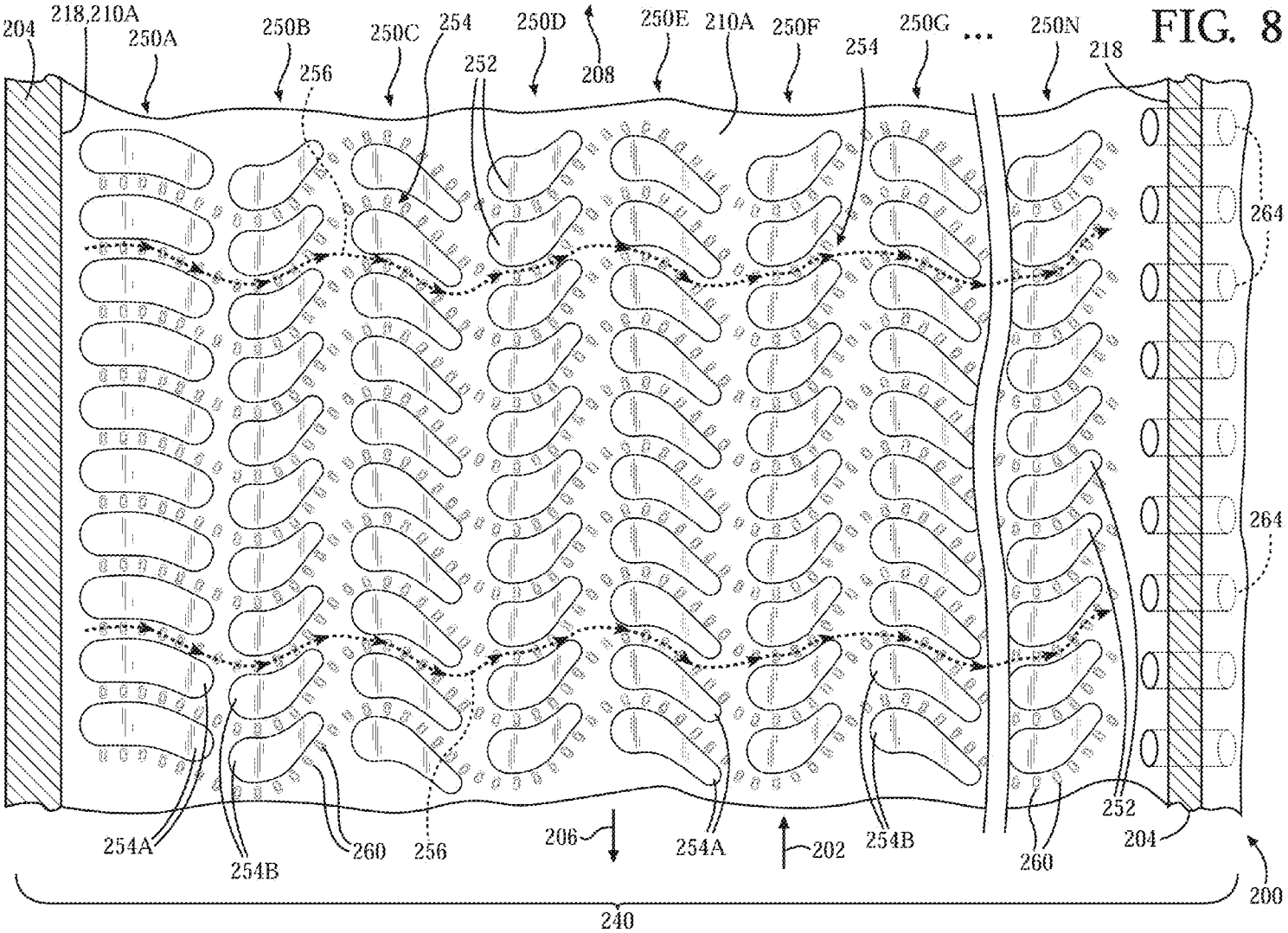
FIG. 8 is an enlarged partial cross sectional view along 8-8 of the turbine blade of FIG. 7 showing cooling channels formed in a suction side cooling circuit of the blade.

Referring now to FIG. 8, a portion of the pressure side cooling circuit 240 is shown. It is understood that the suction side cooling circuit 242 may include generally the same components as the pressure side cooling circuit 240, wherein the suction side cooling circuit 242 will not be separately shown and described herein.

The pressure side cooling circuit 240 comprises a plurality of rows $\mathbf{250}_{A\text{-}N}$ of airfoils 252. The number of rows of airfoils 252 may vary depending on the size and configuration of the airfoil 200 and/or the size and configuration of the airfoils 252 themselves. Radially adjacent airfoils 252 within each row define segments 254 of cooling channels 256 of the cooling circuit 240. The cooling channels 256 of the pressure side cooling circuit 240 are defined between an outer side 230A of the cooling structure 230 and an inner side 210A of the pressure side 210 of the outer wall 204, which defines a portion of the inner side 218 of the outer wall 204, see FIG. 7. It is noted that the cooling channels 256 of the suction side cooling circuit 242 are defined between the outer side 230A of the cooling structure 230 and an inner side 212A of the suction side 212 of the outer wall 204, which also defines a portion of the inner side 218 of the outer wall 204, see FIG. 7.

As shown in FIG. 8, outlets 254A of the segments 254 in one row align aerodynamically with inlets 254B of the segments 254 in an adjacent downstream row to provide the cooling channels 256 with a serpentine or zigzag shape. The present cooling arrangement aligns the outlets 254A and inlets 254B of the segments 254 so that cooling air exiting a segment outlet 254A is aimed toward the next segment's inlet 254B, i.e., such that outlets 254A of the segments 254 in one row align aerodynamically with the inlets 254B of segments 254 in an adjacent downstream row to define continuous cooling channels 256 with non continuous walls, each cooling channel 256 comprising a serpentine or zigzag shape. Aiming of the segment outlets 254A and inlets 254B may be done along a line of sight (mechanical alignment), or it may be configured to take into account the aerodynamic effects present during operation. Additional details in connection with the alignment of the cooling channel segments 254 as shown in FIG. 8 can be found above with reference to the cooling channels 90 of FIG. 5.

The cooling channels 256 may comprise turbulating features 260, such as, for example, bumps, dimples, trip strips, etc. The turbulating features 260 may be provided on the inner side 210A of the pressure side 210 of the outer wall 204 as shown in FIG. 7, and/or on the outer side 230A of the cooling structure 230, and are provided to increase cooling provided by cooling fluid passing through the cooling channels 256.

As shown in FIGS. 7 and 8, the cooling channels 256 of the pressure side cooling circuit 240 are provided with at least one (and preferably a plurality of) outlet passage 264 extending to the pressure side 210 of the outer wall 204. The outlet passages 264 preferably discharge cooling fluid from the airfoil 200 in a direction toward the trailing edge 216 of the outer wall 204, as shown in FIG. 7. Referring to FIG. 8, the outlet passages 264 may be radially spaced apart from the radially inner end 206 of the outer wall 204 to the radially outer end 208 of the outer wall 204. It is noted that outlet passage 266 of the suction side cooling circuit 242 extend from the cooling channels 256 to the suction side 212 of the outer wall 204, as shown in FIG. 7.

Referring back to FIG. 7, the airfoil 200 according to this embodiment of the invention further comprises a trailing edge cooling cavity 280. The trailing edge cooling cavity 280 may include the cooling arrangement 82 disclosed above with reference to FIGS. 3-5.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine airfoil comprising:

an outer wall including a radially inner end, a radially outer end, a suction side, a pressure side, a leading edge, and a trailing edge, the outer wall defining an interior chamber of the airfoil;

an insert provided in the interior chamber, the insert being separately formed from the outer wall of the airfoil and fitted into the interior chamber of the outer wall, the insert defining an interior cooling cavity and including a plurality of radially spaced apart cooling fluid outlet holes formed on the insert, at least one of the outlet holes in communication with a pressure side cooling circuit and at least one of the out let holes in communication with a suction side cooling circuit, wherein at least some of outlet holes formed on the insert discharge cooling fluid from the interior cooling cavity of the insert in a direction toward the leading edge of the outer wall;

at least one of the pressure side cooling circuit and the suction side cooling circuit comprising:

a plurality of rows of airfoils, wherein radially adjacent airfoils within a row define segments of cooling channels, and wherein outlets of the segments in one row align aerodynamically with inlets of segments in an adjacent downstream row, wherein the cooling channels have a serpentine shape, the cooling channels further comprise turbulating features formed on at least one of an inner side of the outer wall and on an outer side of the insert, the turbulating features being, selected from the group including bumps, dimples, and trip strips.

2. The gas turbine engine airfoil of claim 1, wherein the insert is located closer to the leading edge of the outer wall than to the trailing edge of the outer wall.

3. The gas turbine engine airfoil of claim 1, wherein all of the outlet holes in the insert only discharge cooling fluid from the interior cooling cavity of the insert in a direction directly toward the leading edge of the outer wall.

4. The gas turbine engine airfoil of claim 1, further comprising a trailing edge cooling cavity, the trailing edge cooling cavity comprising:

a plurality of rows of airfoils, wherein radially adjacent airfoils within a row define segments of cooling channels, and wherein outlets of the segments in one row align aerodynamically with inlets of segments in an adjacent downstream row such that the cooling channels in the trailing edge cooling cavity have a serpentine shape.

5. The gas turbine engine airfoil of claim 1, wherein each of the pressure side cooling circuit and the suction side cooling circuit comprise:

a plurality of rows of airfoils, wherein radially adjacent airfoils within a row define segments of cooling channels, and wherein outlets of the segments in one row align aerodynamically with inlets of segments in an adjacent downstream row such that the cooling channels in each of the pressure side cooling circuit and the suction side cooling circuit have a serpentine shape.

6. The gas turbine engine airfoil of claim 1, wherein the cooling channels are defined between an outer side of the insert and an inner side of one of the pressure side and the suction side of the outer wall.

7. The gas turbine engine airfoil of claim 1, wherein the cooling channels include at least one outlet passage extending to one of the pressure side and the suction side of the outer wall.

8. The gas turbine engine airfoil of claim 1, wherein the cooling channels include a plurality of radially spaced apart outlet passages extending to one of the pressure side and the suction side of the outer wall.

9. The gas turbine engine airfoil of claim 8, wherein the outlet passages of the cooling channels discharge cooling fluid from the airfoil in a direction toward the trailing edge of the outer wall.

* * * * *